United States Patent [19]

Asmus

[11] 4,216,710

[45] Aug. 12, 1980

[54] VEHICLE EXHAUST HANDLING SYSTEM

[75] Inventor: Carl J. Asmus, Temple City, Calif.

[73] Assignee: Clayton Manufacturing Company, El Monte, Calif.

[21] Appl. No.: 945,554

[22] Filed: Sep. 25, 1978

[51] Int. Cl.[2] ..... F23J 11/02

[52] U.S. Cl. ..... 98/115 R; 98/43 R; 73/117; 104/52

[58] Field of Search ..... 98/115 R, 43 R; 104/52; 73/117

[56] References Cited

U.S. PATENT DOCUMENTS

| | | | |
|---|---|---|---|
| 3,207,055 | 9/1965 | Small | 98/43 |
| 3,415,113 | 12/1968 | Cline | 98/43 |

*Primary Examiner*—Ronald C. Capossela

*Attorney, Agent, or Firm*—Jackson, Jones & Price

[57] ABSTRACT

An improved vehicle exhaust handling system capable of accomodating vehicles of varying sizes while maintaining optimal exhaust capabilities is disclosed. A motor vehicle with its engine operating is positioned in a test center in a predetermined location. A chamber is located in the floor of the test center below the rearward portion of the vehicle. A plurality of hinged shutters and a grate behind the shutters are disposed over the chamber. An exhaust fan creates an airflow from the test center into the chamber and to an outside location. The shutters are individually controllable, and a mechanism is provided to close off a flow of air through the grate whenever any of the shutters is opened. Depending on the size of the vehicle and the position of its tailpipe, an individually selected shutter is opened or all the shutters are closed and the exhaust gases are directed into the grate. Portable deflectors are provided for positioning adjacent to the tailpipe of the vehicle. The deflectors further enhance the exhaust capabilities of the system.

20 Claims, 4 Drawing Figures

VEHICLE EXHAUST HANDLING SYSTEM

BACKGROUND OF THE INVENTION

1. Field of the Invention

The present invention relates to an improved automotive exhaust products evacuating system and more particularly to an improved automotive exhaust products evacuating system to be used in association with a dynamometer, the evacuating system adapted to accomodate motor vehicles of varying sizes while maintaining optimal exhaust capabilities.

2. Description of the Prior Art

When a vehicle having an internal combustion engine is being repaired or undergoing diagnostic testing, it frequently becomes necessary to operate its engine in an enclosed or partially enclosed structure. The need to effectively evacuate the toxic and noxious fumes emitted by the engine of the vehicle is well established in the prior art.

U.S. Pat. No. 3,415,113 describes a vehicle exhaust handling system particularly adapted for use in conjunction with a chassis dynamometer utilized in garages, automotive diagnostic centers or like places. The system described therein essentially comprises a plurality of upwardly opening hinged shutters positioned in a parallel manner and located over a chamber provided in the floor of the testing center.

When the motor vehicle to be tested is positioned with its rear wheels to engage a pair of rollers comprising a part of the dynamometer, the rear end of the motor vehicle is generally disposed over the chamber provided in the floor. An operator of the diagnostic center selects a shutter in closest proximity to the exhaust tail pipe of the vehicle, and opens that shutter. The rest of the shutters generally remain in a closed position. The opened shutter is adjusted to an angular position relative to the floor which provides optimal evacuation of the exhaust gases. A fan operated exhaust device is connected to the chamber in the floor through a suitable duct. The exhaust fan causes rapid flow of air from the space within the diagnostic center through the opened shutter into the chamber. This air captures the bulk of the noxious exhaust gases emanating from the tailpipe of the vehicle.

A second chamber in communication with the exhaust device and covered by a grate is located in front of the dynamometer below the engine of the vehicle. The purpose of this second chamber and grate is to provide general ventilation and to remove exhaust fumes which may leak out from the engine of the vehicle. The airflow through this grate, however, is not adjustable.

An additional disclosure related to an automotive diagnostic system with automatic ventilation may be found in U.S. Pat. No. 3,207,055. Furthermore, additional disclosures relating in general to ventilation and louver systems may be found in U.S. Pat. Nos. 2,293,065, 511,296, 1,412,039 and 1,971,920.

The exhaust product handling system described in U.S. Pat. No. 3,415,113 offers some capability to adjust the air-flow for maximum entrainment of exhuast fumes depending upon the size of the vehicles to be tested. Nevertheless it suffers from the following disadvantages: In order to accomodate vehicles of varying sizes the number of shutters required is relatively large, thereby increasing the cost of manufacturing the system. Furthermore even a large number of shutters may be unable to accomodate some large sized recreational vehicles, or when associated with the dynamometer, vehicles with front wheel drive.

For the above stated reasons a need still exists for an economical, adjustable vehicle exhaust handling system providing optimal exhaust removing capabilities.

SUMMARY OF THE INVENTION

It is an object of the present invention to provide an improved vehicle exhaust handling system which is inexpensive to manufacture.

It is another object of the present invention to provide an improved vehicle exhaust handling system which is adjustable for maximum capture of exhaust gases according to the size of the vehicle and to the location of the tailpipe in the vehicle.

It is still another object of the present invention to provide an improved, adjustable vehicle exhaust handling system which is suitable for use in association with a dynamometer having rollers upon which the drive wheels of the vehicle are positioned.

It is yet another object of the present invention to provide an improved, adjustable vehicle exhaust handling system which is capable of providing general ventilation to the testing center wherein the system is located.

These and other objects and advantages are attained by the vehicle exhaust product handling system described in this invention.

A chamber or pit is provided in a floor of a testing center. A motor vehicle is positioned over the chamber with its engine operating. At least one shutter, but preferrably a plurality of parallelly positioned hinged shutters partially cover the chamber. Each shutter is capable of occupying a closed position wherein it lies substantially flush with the floor and preferrably a plurality of continuously adjustable open positions wherein the shutter is disposed in an angular position relative to the floor.

An exhaust fan adapted for rapid evacuation of air from the test center is connected to the chamber through a duct.

A grate is positioned behind the hinged shutters over the chamber. An additional shutter disposed below the grate is capable of regulating airflow through the grate. Dependant upon the size of the motor vehicle to be tested and the location of its exhaust pipe one of the hinged shutters or the shutter below the grate is opened at the option of an operator of the testing center to provide maximum airflow in the vicinity of the tail pipe of the vehicle.

The objects and features of the present invention are set forth in the appended claims. The present invention may be best understood by reference to the following description, taken in connection with the accompanying drawings in which like numerals indicate like parts.

DESCRIPTION OF THE PREFERRED EMBODIMENT

The following specification taken in conjunction with the drawings sets forth the preferred embodiment of the present invention. The embodiment of the invention disclosed herein is the best mode contemplated by the inventor for carrying out his invention in a commercial environment, although it should be understood that various modifications can be accomplished within the parameters of the present invention.

Figure 1:
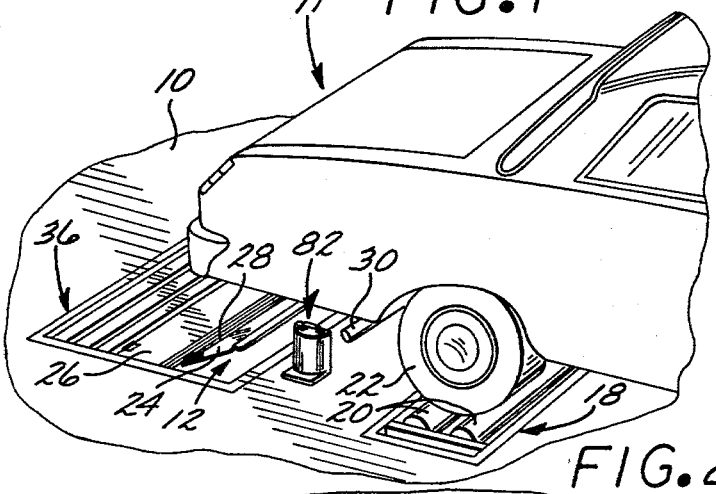
FIG. 1 is a perspective view of a preferred embodiment of the exhaust product handling system of the present invention used in association with a dynamometer.
Figure 2:
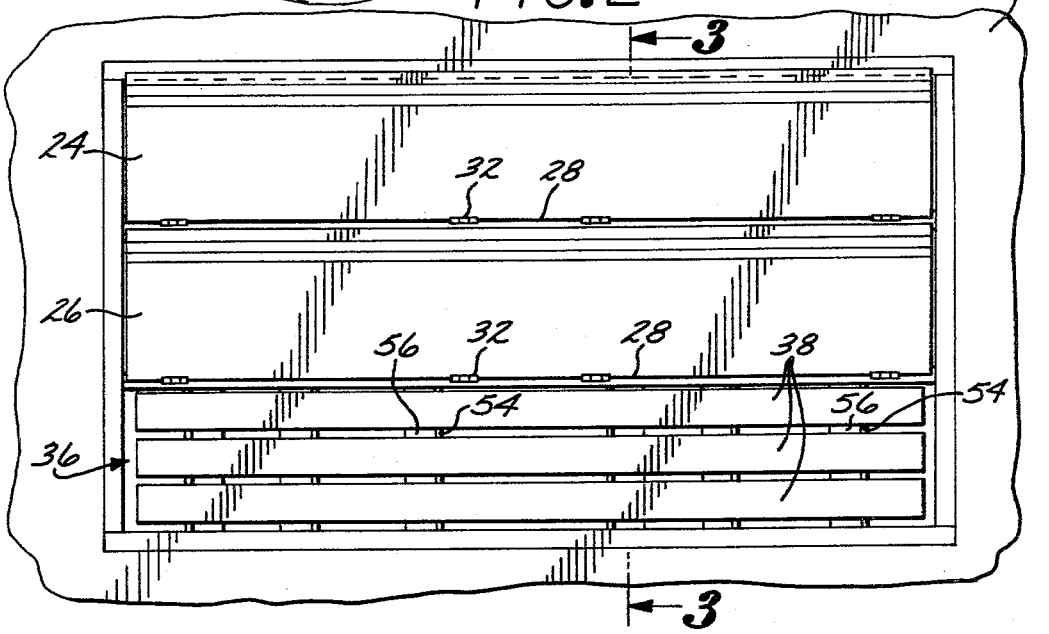
FIG. 2 is a top view of the preferred embodiment of the exhaust product handling system of the present invention.
Figure 3:
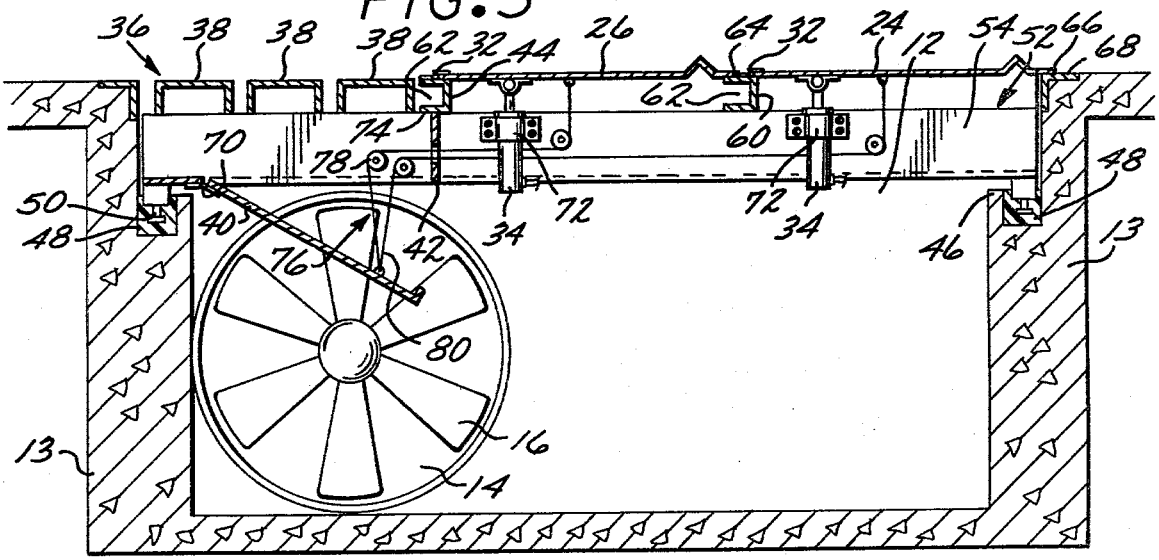
FIG. 3 is a cross sectional view of the preferred embodiment of the exhaust product handling system of the present invention, the cross section being taken at lines 3—3 of FIG. 2.

Referring to FIGS. 1 through 3 and particularly to the cross-sectional view of FIG. 3 a preferred embodiment of the improved exhaust products handling system of the present invention is disclosed. A floor 10 upon which a vehicle 11 to be tested is driven, is located within the enclosed structure (not shown) of a garage or testing center. A chamber or pit 12 having a substantially rectangular cross-section is located within the floor 10. The chamber or pit 12 has concrete walls 13 of an appropriate thickness.

Air may be exhausted from the chamber 12 through a duct 14 preferrably having a circular cross section of a relatively large diameter. A blower or exhaust fan 16 which may be of the variable speed type is disposed within the duct 14. The blower or exhaust fan 16 is designed to create an efficient flow of air from the testing center through the chamber 12 and duct 14 to an appropriate outside location. There the removed air and exhaust gases are dissipated in the atmosphere preferrably through a stack (not shown).

The improved exhaust product handling system of the present invention is particularly suitable for use in association with a chassis dynamometer 18 of the type having a pair of rollers 20 for each drive wheel 22 of the vehicle 11. One pair of the rollers 20 of the dynamometer 18 is shown in FIG. 1. The dynamometer 18 is usually mounted over a second chamber or pit which is not shown here.

Since the construction of the dynamometer 18 is not part of the present invention and is adequately disclosed elsewhere, it need not be described here in detail. It is sufficient to state for the purpose of understanding the present invention that while the vehicle 11 is being tested with its drive wheels 22 engaging the rollers 20, the vehicle is in a fixed position relative to the floor 10. During the testing process actual driving conditions may be simulated. Therefore an engine of the vehicle 11 may be required to produce a large output of power with a resulting large emission of toxic and noxious exhaust fumes or gases.

As it is shown in the perspective view of FIG. 1 the chamber or pit 12 is located rearward of the rollers 20 of the dynamometer 18. In this regard and for the entire description of the present invention, rearward and forward direction is defined by reference to the longitudinal axis of the vehicle 11 to be tested.

In the preferred embodiment of the present invention two shutters 24 and 26 are disposed over a forward portion of the chamber 12. Even though two shutters are shown here, it should be remembered the present invention may be practiced by utilizing only one shutter or more than two shutters. The shutters 24 and 26 are positioned parallelly relative to one another. Each shutter comprises an elongated, substantially rectangular plate, a longer side 28 of which is disposed transversely to the longitudinal axis of the vehicle 11. The length of each shutter is dimensioned to substantially correspond to the width of the chamber 12, which in turn is wide enough to accomodate most of the vehicles to be tested in the garage or test center.

As is shown more particularly in FIG. 2, the shutters 24 and 26 are positioned parallel relative to one another. Shutter 24 is disposed in closer proximity to the exhaust pipe 30 of the vehicle 11 than shutter 26. Both shutters 24 and 26 are appropriately hinged at their respective rear sides by a plurality of hinges 32. The hinges 32 permit the shutters 24 and 26 to be disposed in a closed position wherein they lie substantially flush with the floor 10. When the shutters 24 and 26 are closed, the flow of air from the airspace in the vicinity of the shutters 24 and 26 into the chamber 12 is interrupted.

The hinges 32 allow the shutters 24 and 26 to be opened to a desired extent up to an upper limit. The upper limit of the open position of the shutters may be controlled by the construction of the hinges 32 or by the maximum extendability of a pair of jacks 34 which serve the purpose of opening the shutters 24 and 26 as is illustrated in FIG. 3. Further disclosure about the construction and operation of the jacks is made as the present invention is described below.

The shutters 24 and 26 when open, occupy an angular position relative to the floor 10. Each open shutter defines a passage from the airspace of the test center into the chamber 12 through which air and exhaust gases may flow for ultimate evacuation by the blower 16.

A grate 36 is disposed over the rearward portion of the chamber 12. In the preferred embodiment the grate comprises three intermittently spaced downwardly facing channel irons 38. A horizontally disposed surface of the channel irons 38 may be provided with a plurality of apertures or holes (not shown). The holes serve the purpose of allowing optimally maximized airflow through the entire grate 36.

An additional shutter 40 hinged to open downwardly is positioned below the grate 36 as is shown in FIG. 3. The additional shutter 40 in a closed position lies substantially parallel with the floor 10. It further engages a plurality of substantially vertically disposed aligned sealing plates or seals 42 which are suspended from a suitable channel iron 44. The sealing plates 42 extend from wall to wall 13 within the chamber 12 transversely to the longitudinal axis of the vehicle 11. The channel iron 44 is located between the grate and the second shutter 26 parallel with the rearward side 28 of the shutter 26. Consequently the closed shutter 40 and the sealing plates 42 separate an airspace lying directly below the grate 36 from the rest of the airspace within the chamber 12.

As is readily apparent from the above description, flow of air through the grate 36 into the chamber 12 is regulated by opening or closing the additional shutter 40. In order to fully understand the present invention, a detailed description of the mounting of the shutters 24 and 26 and the construction of the jacks 34 controlling them need not be given as this is fully described in U.S. Pat. No. 3,415,113. The specification of U.S. Pat. No. 3,415,113 is hereby expressly incorporated by reference.

Nevertheless inasmuch as it is relevant to understanding the mounting of the grate 36 and the shutter 40 positioned below, a brief description of the mounting of the entire structure within the floor 10 and the walls 13 of the chamber 12 is provided below.

Referring now particularly to FIG. 3, a ledge 46 is incorporated in the two parallel walls of the chamber 12 which are disposed transversely to the longitudinal axis of the vehicle 11 to be tested. A groove or trough 48 having a substantially rectangular cross section is provided in each ledge 46. A plurality of anchor posts 50 are fixedly embedded in the grooves or troughs 48. The embedding is conveniently accomplished by the use of an appropriate grouting material.

The anchor posts 50, shown in FIG. 3, support 6 angle irons 52 as may be seen in FIG. 2. Each angle iron 52 comprises a vertically and horizontally positioned plate, 54 and 56 respectively. Each horizontally positioned plate 56 is attached to an anchor post 50 at either opposite wall of the chamber 12. For the purpose of fixedly attaching the angle irons 52 to the anchor posts 50, each anchor post 50 may be provided with an internally threaded aperture (not shown). The attachment may be accomplished by appropriately sized bolts (not shown).

The vertically disposed plates 54 of the angle irons 52 support two channel irons 44 and 60 which are disposed with their longitudinal axis at a right angle to the longitudinal axis of the angle irons 52. Both channel irons 44 and 60 are positioned in the preferred embodiment with their open channel face 62 pointing rearward toward the grate 36. The two channel irons 44 and 60 are spaced apart from each other at a requisite distance to provide support to the hinged shutters 24 and 26.

Thus the first, rearmost channel iron 44 supports the hinge 32 attached to the rearmost shutter 26. The second chanel iron 60 supports a forward edge 64 of the rearmost shutter 26 when it is in a closed position. The second channel iron 60 also supports the hinge 32 attached to the shutter 24. A forward edge 66 of the shutter 24 is supported by an additional angle iron 68 which is embedded in the longer wall of the chamber 12.

The vertical plates 54 of the six angle irons 52 also support the three downwardly facing channel irons 38. These are disposed at a right angle to the angle irons 52 and are fixedly attached thereto. As it was pointed out above, these three channel irons 38 comprise the grate 36.

The horizontally disposed plates 56 of the angle irons 52 provide support for a hinged structure 70 supporting the additional shutter 40 which is located below the grate 36.

Finally the angle irons 52 provide support for a plurality of suitable mounting brackets 72 which hold the jacks 34. Alternatively the jacks 34 may be mounted by separate mounting hardware (not shown) embedded in the floor or walls 13 of the chamber 12. As briefly pointed out above, the sealing plates or seals 42 are fixedly attached to a lower plate 74 of the rearmost channel iron 44.

It is to be noted with regard to the attachment to one another of the various structural members of the present invention that various conventional methods of fixedly attaching the same may be employed. These include attachment by suitable nuts and bolts. However the preferred method of attachment comprises welding, or a combination of the two methods may be employed. Thus, in the preferred embodiment the three downwardly facing channel irons comprising the grates are welded to the six angle irons 52, while the angle irons 52 themselves are bolted to the anchor posts 50.

The angle irons 52, all the channel irons 38, 44 and 60 and the hinged shutters 24 and 26 are made of steel of sufficient strength to support the weight of a vehicle which may be driven over the entire structure.

The entire exhaust product handling system of the present invention is designed with such dimensions that the exhaust pipe 30 of most full size American made passenger cars is located in the general vicinity of the second, rearmost shutter 26. On the other hand, the exhaust pipe 30 of most of the smaller compact, subcompact or foreign made cars is located in the general vicinity of the first, foremost shutter 24. In case of larger vehicles, such as some recreational vehicles or vehicles having front wheel drive, where the front wheels engage the rollers 20 of the dynamometer 18, the exhaust pipe 30 is generally located over the grate 36.

It is to be noted in this connection that most garages or testing centers have only one limited position for the vehicles to be tested even in the absence of a dynamometer. Therefore the improved exhaust product handling system of the present invention is useful in those garages as well, where the dynamometer is absent.

In order to capture substantially all of the exhaust gases emitted from the tail pipe 30 of the vehicle 11, the shutter in closest proximity to the tail pipe 30 is opened. In this regard it should be noted that an operator of the testing center or garage may simply visually check which shutter will readily clear the rear overhang of the vehicle 11 and open that shutter. Since the position of the shutter may be continuously adjustable, the shutter may be opened to a desired degree to provide for an optimal airflow to capture the exhaust gases. The ability to open the shutter to a desired degree accomodates vehicles having their tail pipes at various heights.

The opening and closing of the hinged shutters 24 and 26 is accomplished by the jacks 34, which are individually controllable. A detailed description of the jacks 34 and their operative mounting to the shutters 24 and 26 need not be provided here, since they are amply described in U.S. Pat. No. 3,415,113. The specification of this patent is hereby expressly incorporated by reference for this purpose also. It is sufficient to state that each jack 34 is actuated by an appropriate fluid such as air, or oil under pressure and is controlled through a switch in a suitable location in the testing center (not shown).

Since the maximum air velocity in the vicinity of the pipe 30 is required to provide for maximum entrainment of the exhaust gases, only one shutter is opened at a time at the option of the operator of the testing center. In order to further maximize the velocity of air flow in the area adjacent to the tail pipe 30 and through the opened shutter 24 or 26 it is desirable to have the shutter 40 below the grate 36 closed. The opening and closing of shutter 40 may be accomplished by a fluid operated jack (not shown) similar to the jacks 34 disclosed for controlling the hinged shutters 24 and 26. A jack controlling the additional shutter 40 may be individually controllable. Alternatively its operation may be tied by suitable solenoid valves and appropriate electric circuitry to the operation of the jacks 34. In this case whenever any of the hinged shutters 24 and 26 is opened, the additional shutter 40 below the grate 36 is closed. The design of the appropriate circuitry with the use of solenoid valves to accomplish this interconnection of the shutters 24, 26 and 40 is well within the present state of the art, and therefore need not be disclosed here in detail.

In the preferred embodiment of the present invention described here, the opening and closing of the additional shutter 40 is controlled by a cable and pulley mechanism 76 shown in FIG. 3. This mechanism includes two pairs of pulleys 78 attached to the vertical plate 54 of an angle iron 52. The pulleys 78 are preferrably attached to the third or fourth angle iron 52 as counted from a longitudinally aligned wall 13, shown in FIG. 3, of the chamber 12. A cable 80 of appropriate length is fixedly attached to a lower surface of each hinged shutter 24 and 26. It is led through a pair of pulleys 78 for fixed attachment to an upper surface of the shutter 40. In order to prevent the cable 80 from disengaging the pulleys appropriate cable guides (not shown) are provided on the pulleys. Alternative cable and pulley arrangements (not shown) wherein only one cable connected to both shutters 24 and 26 is utilized, may also be employed in the present invention. Such an arrangement, which prevents a slack from developing in the cable whenever any of the shutters 24 or 26 is lifted, is well known in the prior art and need not be disclosed here in detail.

As is readily apparent from the above description when the two shutters 24 and 26 are closed, the length of the cables 80 allows the shutter 40 to pivot under the force of its own weight around the hinged structure 70 to an open position. Whenever either one of the shutters 24 and 26 is lifted by the jacks 34 the cable 80 lifts the shutter 40. As either hinged shutter 24 or 26 reaches a predetermined extent of opening, the additional shutter 40 reaches a fully closed position. Thus the cable and pulley mechanism 76 provides for automatic operation of the shutter 40 which controls air flow through the grate 36.

As pointed out above, in the case of an oversized vehicle or a vehicle having front wheel drive, the tail pipe 30 is likely to be located in the general vicinity of the grate 36. When this occurs, the operator of the test center closes both shutters 24 and 26 thereby automatically creates a rapid flow of air through the grate 36. This airflow captures the bulk of the exhaust fumes emitted by the oversized or front-wheel-drive vehicle.

Figure 4:
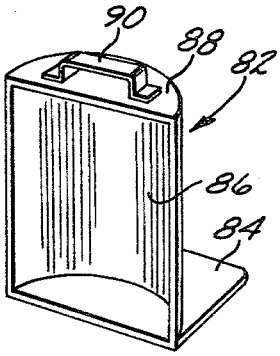
FIG. 4 is a perspective view of a preferred embodiment of a portable deflector of the present invention.

In order to further maximize the evacuation of the noxious exhaust fumes from the test center, at least one portable deflector 82, shown in FIGS. 1 and 4 is provided. The deflector 82 has a substantially flat rectangular support plate 84, and a substantially semicylindrical body 86 fixedly mounted in an erect position on the support plate 84. A top plate 88 comprising a hemicircle is fixedly mounted on top of the semicylindrical body 86. A suitable handle 90 is attached to the top plate 88.

The deflector 82 may be positioned on the floor 10, as shown in FIG. 1, with its open cylindrical side facing the tail pipe 30. The exhaust fumes emanating from the tail pipe 30 are directed by the deflector 82 into the path of the airflow into the open shutter 24 or 26. In the case of oversized or front-wheel-drive vehicles the deflector 82 is positioned in an appropriate location on the grate 36 to direct the exhaust fumes thereinto.

The interconnection of the shutters 24 and 26 with the shutter 40 also serves the purpose of providing general ventilation to the test center through the grate whenever the shutters 24 and 26 are closed and the exhaust fan 16 is in operation.

What has been described above is an improved vehicular exhaust removal system adjustable for optimal capture of exhaust fumes emitted by vehicles of varying sizes. It will be apparent to those skilled in the art that various modifications of the present invention are possible, and accordingly the scope of the present invention should be interpreted solely from the following claims.

What is claimed is:

1. An automotive engine exhaust products removing system comprising:

a floor upon which a vehicle may be driven, the floor having at least one upwardly opening chamber therein and an exhaust outlet opening operatively connected to the chamber;

at least one hinged shutter partially covering the chamber, the shutter being movable between a closed position wherein a top surface thereof lies substantially flush with the floor, and an open position wherein the shutter is raised above the floor to an angular position;

a grate positioned rearward of the shutter and over the chamber;

an additional shutter positioned below the grate, the shutter being movable between a closed position wherein it substantially impedes a flow of air and exhaust products through the grate, and an open position wherein the flow of air and exhaust products through the grate is substantially unobstructed;

first means for selectively opening and closing the hinged shutter;

second means for selectively opening and closing the additional shutter, and third means for evacuating air and automotive engine exhaust products from the chamber through the outlet opening.

2. The invention of claim 1 wherein the first means for selectively opening and closing the hinged shutter comprise a jack actuated by a fluid under pressure.

3. The invention of claim 1 wherein the second means for selectively opening and closing the additional shutter below the grate comprise a cable and pulley assembly.

4. The invention of claim 3 comprising more than one hinged shutter and wherein the cable and pulley assembly is operatively connected with each and every one of the shutters for closing the additional shutter whenever any of the hinged shutters is opened to a predetermined extent.

5. The invention of claim 1 further comprising at least one portable deflector, the deflector capable of being positioned so as to deflect and direct air and exhaust products for passage through one of the grate and an opened shutter into the chamber.

6. The invention of claim 1 wherein the third means comprise a fan operated blower assembly.

7. An automotive engine exhaust products removing system having exhaust means to be used in combination with a testing apparatus including roll means for receiving and supporting the drive wheels of a motor vehicle to be tested, the motor vehicle being driven upon a floor having at least one upwardly opening chamber therein and an air outlet passage connected to the chamber, the exhaust products removing system comprising:

a grate through which air can be moved by the exhaust means;

at least one hinged shutter positioned between the roll means and the grate, the shutter lying substantially over the chamber in a closed position, the shutter capable of being selectively pivoted around the hinge up to a predetermined extent in which the shutter is angularly disposed relative to the floor thereby permitting flow of air and automotive exhaust gases into the chamber;

an additional shutter operable for selectively permitting and blocking the flow of air and automotive exhaust gases through the grate;

frame means attached to one of the floor and a plurality of walls of the chamber, the frame means supporting at least the hinged shutter, and means for automatically closing the additional shutter whenever the hinged shutter is opened to a predetermined extent.

8. The invention of claim 7 further comprising an air seal mounted to the frame means, the air seal and the additional shutter in a closed state separating an airspace located substantially below the grate from the airspace in the rest of the chamber.

9. The invention of claim 7 further comprising at least one fluid actuated jack to selectively open and close the hinged shutter.

10. The invention of claim 9 wherein the means for automatically closing the additional shutter comprise a cable and pulley assembly operatively connected to the hinged shutter and to the additional shutter.

11. The invention of claim 7 wherein the hinged shutter is positioned substantially parallel relative to a longitudinal axis of the roll means and relative to a longitudinal axis of the grate thereby being positioned substantially transversely to a longitudinal axis of the motor vehicle to be tested, the shutter in its open position defining a passage opening towards the roll means wherethrough air and automotive exhaust products may flow.

12. The invention of claim 11 where there are at least two parallelly positioned hinged shutters.

13. The invention of claim 12 wherein the means for automatically closing the additional shutter comprise a cable and pulley assembly operatively connected to all of the hinged shutters and to the additional shutter.

14. In an automotive exhaust product removal system having means for evacuating air, a floor upon which a vehicle having an exhaust pipe may be driven, the floor including at least one chamber operatively connected to the means for evacuating air and a passage through which air and automotive exhaust gases may flow into the chamber to be evacuated therefrom the improvement comprising:

a plurality of selectively operable parallelly positioned hinged shutters, each shutter capable of being disposed in a closed position wherein it lies substantially flush with the floor, and in a plurality of continuously adjustable open positions wherein it defines an angle with the floor;

a grate positioned rearward of the hinged shutters, the rearward direction being defined by a longitudinal axis of the vehicle, the grate being operatively connected to the means for evacuating air whereby air and automotive exhaust products may flow through the grate to be exhausted;

frame means for mounting in the floor to support the hinged shutters and the grate, and means for selectively impeding and allowing flow of air and automotive exhaust products through the grate for evacuation.

15. The improvement of claim 14 wherein the means for selectively impeding and allowing flow of air through the grate comprise an additional shutter mounted below the grate.

16. The improvement of claim 15 wherein the additional shutter is also a hinged shutter.

17. The improvement of claim 14 wherein the hinged shutters are selectively operated by a plurality fluid actuated jacks, one jack being operatively connected to each hinged shutter.

18. The improvement of claim 17 wherein the means for selectively impeding and allowing flow of air through the grate is an additional shutter, the additional shutter being operatively connected to each hinged shutter by second means for closing the additional shutter whenever any of the hinged shutters is opened to a predetermined extent and for opening the additional shutter whenever all the hinged shutters are closed.

19. The improvement of claim 18 wherein the second means comprise a cable and pulley assembly.

20. The improvement of claim 19 further comprising at least one portable deflector for positioning substantially adjacent to the exhaust pipe of the vehicle and for directing automotive exhaust gases into one of the hinged shutters and the grate for evacuation.

* * * * *